US007682232B2

(12) United States Patent
Howard

(10) Patent No.: US 7,682,232 B2
(45) Date of Patent: Mar. 23, 2010

(54) DRIPLESS CHIMNEY CAP

(75) Inventor: George W. Howard, Green Lane, PA (US)

(73) Assignee: Olympia Chimney Supply, Scranton, PA (US)

( * ) Notice: Subject to any disclaimer, the term of this patent is extended or adjusted under 35 U.S.C. 154(b) by 110 days.

(21) Appl. No.: 11/900,676

(22) Filed: Sep. 13, 2007

(65) Prior Publication Data

US 2008/0070491 A1 Mar. 20, 2008

Related U.S. Application Data

(60) Provisional application No. 60/844,909, filed on Sep. 16, 2006.

(51) Int. Cl.
*F23L 17/14* (2006.01)
*F23L 17/02* (2006.01)
*F23J 13/08* (2006.01)

(52) U.S. Cl. ..... 454/35; 454/3

(58) Field of Classification Search ..... 454/3, 454/4, 8, 12, 33, 34, 35, 36, 37, 38, 39, 40, 454/41

See application file for complete search history.

(56) References Cited

U.S. PATENT DOCUMENTS 113,961 A * 4/1871 Abbott ..... 55/445
119,885 A * 10/1871 Roth ..... 454/33
350,800 A * 10/1886 Bradbeer ..... 454/3
852,480 A * 5/1907 Whitehead ..... 454/36
991,941 A * 5/1911 Boettcher ..... 454/13
1,893,272 A * 1/1933 Clay ..... 454/361
1,996,098 A * 4/1935 Chase ..... 431/146
2,240,851 A * 5/1941 Lowther ..... 261/119.1
2,392,742 A * 1/1946 Jenkins ..... 454/37
3,183,822 A * 5/1965 Stone et al. ..... 454/38
4,236,443 A * 12/1980 Schossow ..... 454/8
4,397,225 A * 8/1983 Patton ..... 454/368

FOREIGN PATENT DOCUMENTS

EP 801266 A2 * 10/1997

* cited by examiner

*Primary Examiner*—Steven B McAllister
*Assistant Examiner*—Patrick F. O'Reilly, III

(57) ABSTRACT

The present invention relates to a dripless chimney cap which prevents condensates from dripping down the outside of a chimney. The dripless chimney cap includes a cone-shaped top cap at the top of the chimney cap for stopping liquids and objects from falling into the chimney. A condensation drip pan in the shape of an inverted cone is positioned below the top cap and functions to catch and collect condensates, directing them toward the inside of the chimney flue. A mounting flange attaches to the chimney and secures the condensation drip pan and top cap to the chimney. A screen mesh located between the condensation drip pan and the mounting flange is designed to allow cross air flow.

20 Claims, 4 Drawing Sheets

DRIPLESS CHIMNEY CAP

CROSS REFERENCE TO RELATED APPLICATIONS

The present application claims priority to U.S. Provisional Patent Application No. 60/844,909, entitled "Dripless Chimney Cap", filed on Sep. 16, 2006 by the same inventor, George W. Howard, the entirety of which is incorporated herein by reference.

BACKGROUND OF THE INVENTION

1. Field of the Invention

The present invention relates to a dripless chimney cap employed with or without a stainless steel chimney liner and top plate, in the protection of a chimney from the natural elements of the outside environment and naturally occurring condensation.

2. Discussion of Related Art

A chimney has an opening running its length for conveying exhaust gases from a fireplace, furnace or boiler acting as a heating source. Combustion products in the form of hot exhaust gases rise up the chimney to the outside. They are typically vertical to ensure that the hot gases flow smoothly upward.

The most common fuel sources for modern heating sources include natural gas, liquefied petroleum gas, fuel oil, coal and wood.

All of the above stated combustible sources when burned produce gases and other byproducts such as residue which flow upward within the chimney.

A chimney cap is typically located at the uppermost portion of a chimney to protect the chimney from the external natural elements such as precipitation. It also prevents animals and objects from getting into the chimney. They also act as a spark arrestor.

When the heat, gases and other byproducts flow upward within the chimney, the hot gases cool and create byproducts and residue on the underside of the chimney cap. These condensates drip down onto the top of the chimney and can cause staining, discolorization and corrosion of various materials. These condensates tend to drip out of the chimney cap and onto the outside of the chimney and the roof and walls of the house to which it is attached.

To make this a larger problem, dyes are added to heating oils during their production to differentiate them from diesel oil. These dyes condense out of the exhaust gases. Therefore the condensates can cause considerable staining, discolorization and corrosion.

Some prior art chimney caps are designed to have an open screen section to allow greater exhaust flow. Some of these are designed to allow the condensate to drip into the chimney opening in the absence of cross wind. However, with the pitch of the outer edge of the chimney cap sloping downward, outside the diameter of the chimney opening, the condensate continues to fall on the outside of the chimney opening, with or without a cross wind, causing staining, corrosion and discoloration.

Currently there is a need for a chimney cap system which prevents condensate dripping on the outside of the chimney and the house to which it is attached, so as to prevent staining, discolorization and corrosion of the chimney, even in windy conditions.

SUMMARY OF THE INVENTION

One embodiment of the present invention is a chimney cap [1100] mounted on an opening of the chimney which protects it from the penetrating external natural elements, while at the same time preventing the dripping of potentially staining condensates which occurs in the chimney as a result of combustion of suitable fuels in a heating source. The system comprises:

a. a downward sloping surface being a top cap [1110] for stopping liquids and objects from falling into said chimney;

b. a condensation drip pan [1120] connected to the lower side of the top cap [1110], having a surface sloping downward toward the center of said chimney opening, functioning to collect condensates from the top cap [1110] and direct the condensates toward said center of said chimney opening;

c. mounting flange [1130] for attaching the condensation drip pan [1120] to said chimney.

OBJECTS OF THE INVENTION

It is an object of the present invention to provide a system which protects chimneys from the natural elements while preventing dripping of condensates from running down the outside of the chimney flues.

It is another object of the present invention to provide a chimney cap which protects against dripping of condensates and residue onto the outside of the chimney.

It is another object of the present invention to provide a system which, protects against the dispersion of potentially staining condensate that occurs as a result of horizontal wind gusts acting on the condensate.

It is another object of the present invention to provide a system which, though it is anchored to the chimney, can be removed from the chimney crown for maintenance purposes.

It is another object of the present invention to provide a system which is functional while maintaining aesthetic appeal.

It is another object of the present invention to provide a cap for a chimney which keeps the outside of the chimney clean.

BRIEF DESCRIPTION OF THE DRAWINGS

The advantages of the instant disclosure will become more apparent when read with the specification and the drawings, wherein.

DETAILED DESCRIPTION OF THE INVENTION

Heating sources such as fireplaces, furnaces and boilers employ a chimney to exhaust the combustion gases. Typically, chimney caps are incorporated to prevent precipitation, animals and objects from falling into the chimney. The problem with prior art chimney cap designs is that when exhaust gases condense as they cool, they collect as a condensate on the inside of the chinmey cap 1110. The condensate typically drips down the outside of the chimney and house.

Ultimately, this dripping can produce aesthetically unwelcomed staining on the chimney cap, chimney and structure of which the chimney is contained within, which results in unappealing and unappreciated staining as well as costs and time spent on behalf of the owner of the chimney to remove the staining. The present invention prevents these problems while preserving the function of the chimney cap. This can be seen in the attached figures.

Figure 1:
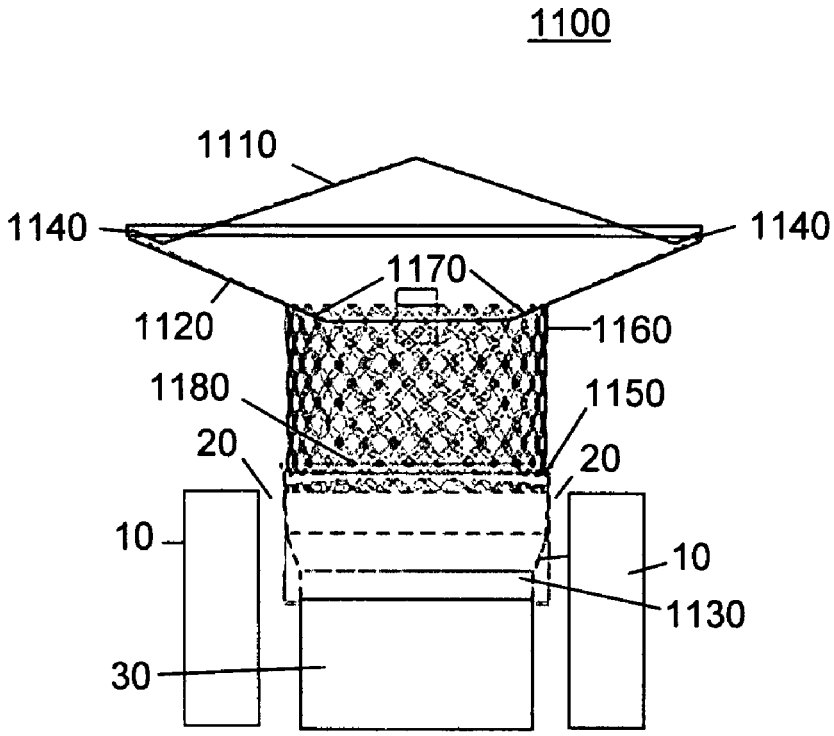
FIG. 1 is a side elevational view of one embodiment of a dripless chimney cap according to the present invention.

FIG. 1 is a side elevational view of one embodiment of a dripless chimney cap [1100].

Figure 2:
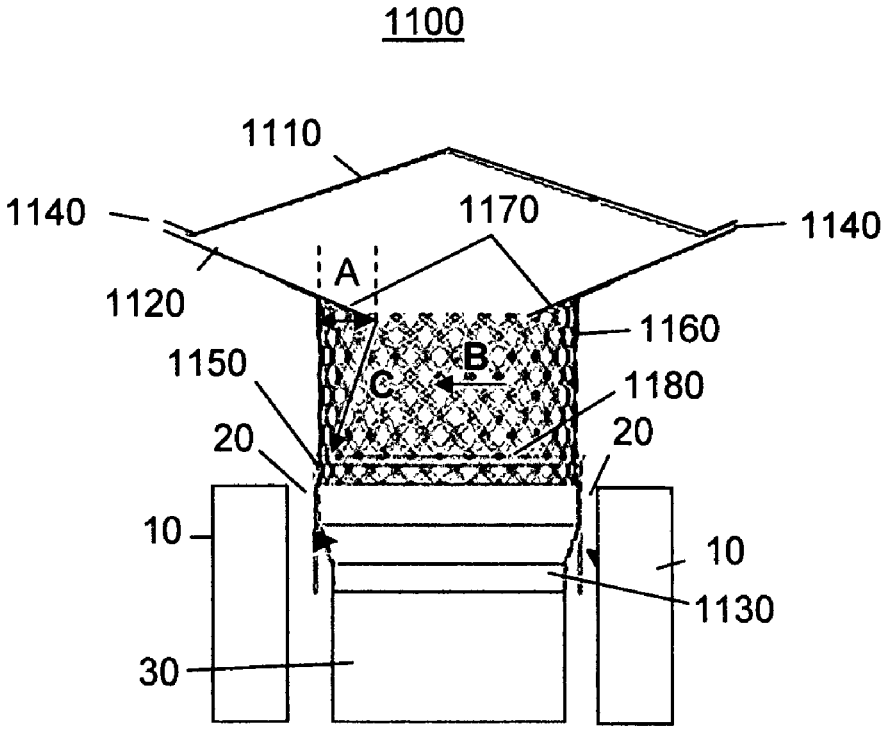
FIG. 2 is a side elevational, cut-away view of the embodiment of the dripless chimney cap shown in FIG. 1.

FIG. 2 is a side elevational, cut-away view of the embodiment of a dripless chimney cap [1100] shown in FIG. 1.

The present invention will be described in connection with FIGS. 1 and 2.

A chimney 10 coupled to a heating unit has an opening 20. Typically, these chimneys 10 employ chimney liners 30. Smoke and other combustion gases flow up liner 30 and out of chimney opening 20. Many times, objects, rain and snow fall into chimney opening 20 weathering the chimney and heating unit at the bottom of liner 30.

In the past chimney caps have been used; however, they typically allow condensate to run down the chimney 10 causing corrosion, discoloration and staining, weakening the chimney 10 and making it aesthetically unpleasing.

The present invention is directed toward reducing these problems. A dripless chimney cap 1100 according to the present invention is attached to the chimney liner 30 with a mounting flange 1130.

The dripless chimney cap 1100 employs a top cap 1110 at the uppermost point of the chimney cap system 1100, being a downwardly angled surface over the chimney opening. The top cap 1110 prevents rain, snow, animals and other objects from falling into the chimney opening. It also acts as a spark arrestor.

The top cap 1110 with a slightly larger diameter than the condensation drip pan 1120 is centered over condensation drip pan 1120. The top cap 1110 and drip pan 1120 are secured together with spacers between them. This produces a gap between top cap 1110 and drip pan 1120 to form a continuous air vent 1140. This allows gases trapped under top cap 1110 to escape.

The condensation drip pan 1120 has a surface which slopes downwardly toward the center of an opening 1180 of the mounting flange 1130. Hot exhaust gases contact the lower side of top cap 1110 and condense. The condensate collects and drips downward onto drip pan 1120.

Drip pan 1120 directs the condensate toward the center of mounting flange opening 1180 and down liner 30. This prevents dripping of the condensate to the outside of chimney 10 reducing corrosion, discoloration and staining of the exterior of the chimney 10.

A screen mesh 1160 may be used which fits between the mounting flange 1130 and the drip pan 1120. This allows increased exhaust gas flow. If screen mesh 1160 is employed, an extension 1170 of drip pan 1120 is employed to direct the dripping condensate further to the center of the chimney opening 20 so that cross winds do not blow the condensate to drip to the outside of chimney opening 20.

An optional flared lip 1150 may be employed which extends from and around the top side of mounting flange 1130. It allows increased surface area to collect more condensate dripping from the chimney cap 1100. In effect, this allows a bigger 'net' to catch the dripping condensate, especially if cross winds blow condensate onto screen mesh 1160.

In FIG. 2, the extension 1170 of the drip pan 1120 is more clearly shown. It extends a distance marked "A" inwardly, toward the center of chimney opening 20. The distance is selected to insure that condensate dripping downward affected by a cross wind of a defined maximum speed in the direction of the arrow marked "B" will still fall into mounting flange opening 1180. The path of dripping condensate is marked "C".

In order to further insure that the condensate drips within mounting flange opening 1180, the flared lip 1150 is employed.

Mounting flange 1130 connects to the condensation drip pan 1120 and secures the chimney cap system to the chimney.

Figure 3:
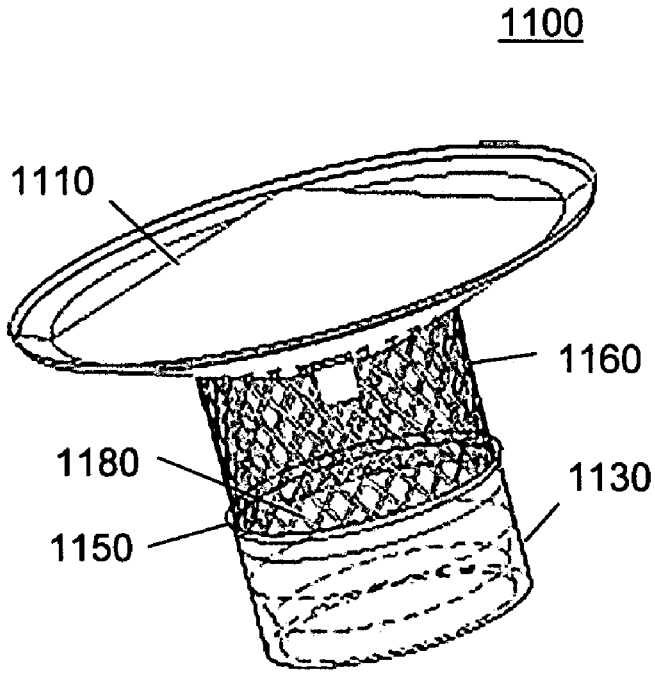
FIG. 3 is a top isometric view of one embodiment of the dripless chimney cap shown in FIGS. 1-2.

FIG. 3 is a top isometric view of one embodiment of a dripless chimney cap 1100 according to the present invention. All of the same parts have the same numbers as the other figures.

In this view, the dripless chimney cap [1100] is shown without the chimney 10 and liner 30. The flared lip 1150 and the mounting flange opening 1180 are more visible from the viewpoint of this figure.

Figure 4:
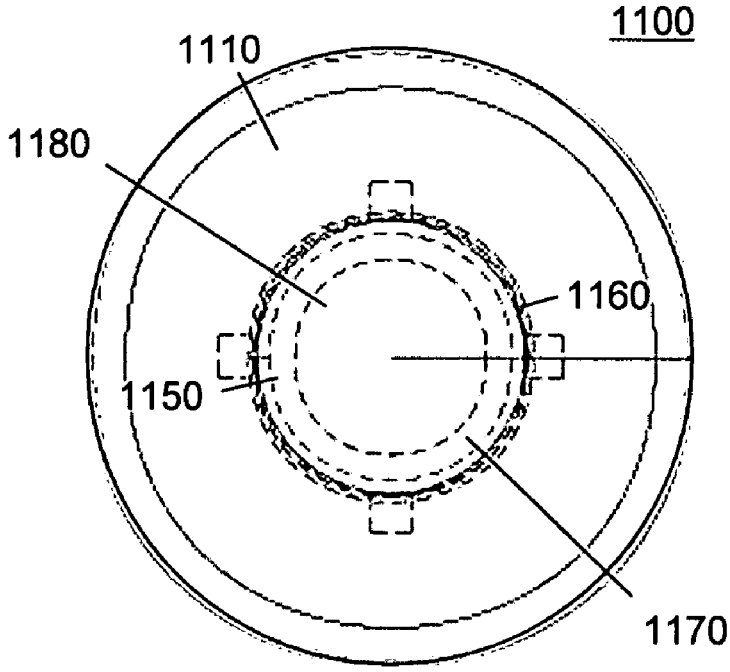
FIG. 4 is a top plan view of the embodiment of the dripless chimney cap shown in FIGS. 1-3.

FIG. 4 is a top plan view of the embodiment of a dripless chimney cap shown in FIGS. 1-3. In this view the funnel shape of the optional flared lip 1150 can be seen.

Also it can be seen how pan extension 1170 has a smaller radius opening than flared lip 1150.

Figure 5:
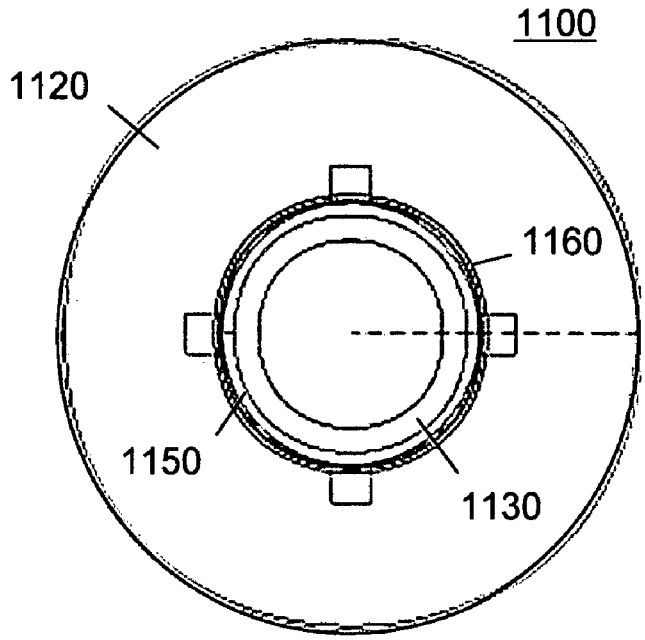
FIG. 5 is bottom plan view of the embodiment of the dripless chimney cap shown in FIGS. 1-4.

FIG. 5 is bottom plan view of the embodiment of a dripless chimney cap shown in FIGS. 1-4. Here drip pan 1120 is plainly visible. Looking from the bottom, mounting flange 1130, flare lip 1150 and screen mesh 1160 are shown going from inside to outside.

Figure 6:
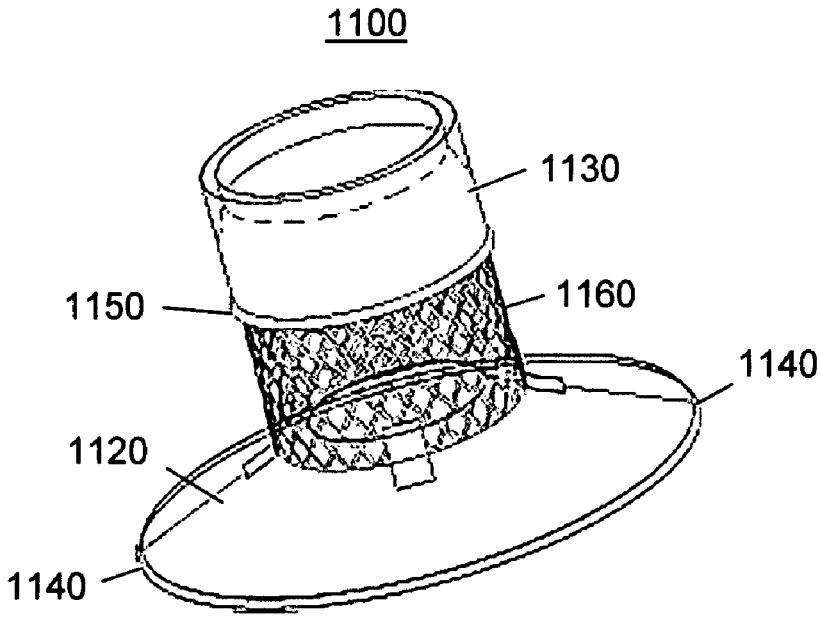
FIG. 6 is a bottom isometric view of the embodiment of the dripless chimney cap shown in FIGS. 1-5.

FIG. 6 is a bottom isometric view of the embodiment of a dripless chimney cap shown in FIGS. 1-5.

Also, the dripless chimney cap 1100 may be embodied without screen mesh 1160. An air gap may be provided between drip pan 1120 and mounting flange 1130 to allow exhaust gases to exit.

Similarly, dripless chimney cap 1100 may be embodied without screen mesh 1160 and have a larger continuous air vent 1140 between the top cap 1110 and the drip pan 1120.

Even though the chimney cap 1100 has been shown as having a round cross section, it may also be embodied with any number of cross sectional shapes including oval, square and rectangular cross sections. These have all been contemplated and are within the scope of the present invention.

Figure 7:
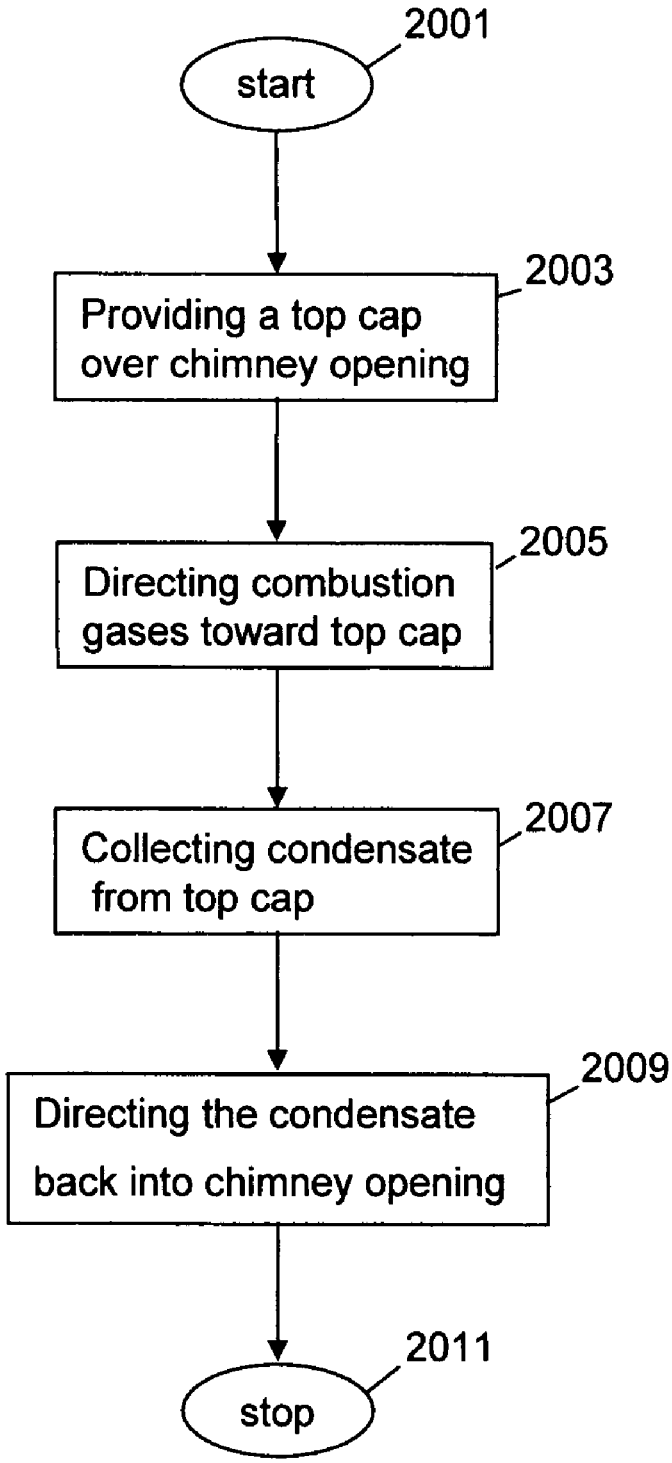
FIG. 7 is a simplified block diagram illustrating one embodiment of a method of the present invention.

The present invention may also be embodied as a method for reducing staining from condensates dripping down an outside surface of a chimney. FIG. 7 is a simplified block diagram illustrating one embodiment of a method of the present invention.

The process starts at step 2001.

In step 2003, a top cap is provided over chimney opening.

The top cap has a surface which slopes downwardly and outwardly away from the chimney opening to a lip on its outermost extent.

In step 2005, combustion gases from the chimney opening are allowed to impinge upon the underside surface of the top cap. The combustion gases condense into condensate which runs down the inner surface of the top cap.

In step 2007, condensates are collected with a drip pan catching drippings of condensation from the top cap.

In step 2009, the collected condensate is directed back into the chimney opening by the drip pan. The drip pan has a sloping surface which extends further outwardly than the top cap to catch the dripping from the top cap. The drip pan then slopes downwardly and inward extending over the chimney opening. The drip pan also has a center opening above the chimney opening. Therefore, the condensate runs down the sloping surface of the drip pan and falls through the center opening of the drip pan.

The condensate then falls into the chimney opening.

The process ends at step 2011.

Although preferred embodiments have been described, other embodiments and modifications of the invention are intended to be covered by the spirit and scope of the present application.

What is claimed is:

1. A dripless chimney cap for mounting on an opening of a chimney comprising:

a top cap having a surface sloping downward in an outward radial direction covering the chimney opening;

a condensation drip pan connected to, and spaced apart from, a lower side of the top cap and having a surface sloping downward radially toward an open center and a perimeter located within a perimeter of the top cap that forms a first continuous air vent thereabove with the lower side of the top cap;

a gap defined between the top cap and the condensation drip pan that converges in an outward radial direction towards the first continuous air vent; and a second air vent connected between the condensation drip pan and a mounting flange;

the mounting flange used to attach the dripless chimney cap to a top end of a chimney pipe; and wherein an entrance to the second air vent is in fluid communication with an entrance to the first continuous air vent via a first continuous air vent structure.

2. The dripless chimney cap of claim 1, wherein the mounting flange further comprises a flared lip extending upward and outward.

3. The dripless chimney cap of claim 1 wherein the second air vent is a screen mesh.

4. The dripless chimney cap of claim 3 further comprising a drip pan extension extending toward the center of the chimney opening beyond the mounting flange.

5. The dripless chinmey cap of claim 1 wherein the top cap and drip pan have a generally circular cross-sectional shape.

6. The dripless chinmey cap of claim 1 wherein the top cap and drip pan have a generally oval cross-sectional shape.

7. The dripless chinmey cap of claim 1 wherein the top cap and drip pan have a generally rectangular cross-sectional shape.

8. The dripless chinmey cap of claim 1 wherein the top cap and drip pan have a generally square cross-sectional shape.

9. A dripless chimney cap for retrofitting an existing chimney cap having an existing mounting flange mounted to a top end of an existing chimney comprising:

a top cap having a surface sloping downward in an outward radial direction covering the chimney opening;

a condensation drip pan connected to, and spaced apart from, a lower side of the top cap and having a surface sloping downward radially toward an open center and a perimeter located within a perimeter of the top cap that forms a first continuous air vent thereabove with the lower side of the top cap;

a gap defined between the top cap and the condensation drip pan that converges in an outward radial direction towards the first continuous air vent; and a second air vent connected between the condensation drip pan and the existing mounting flange that is mounted to the top end of the existing chimney pipe; and wherein an entrance to the second air vent is in fluid communication with an entrance to the first continuous air vent via a first continuous air vent structure.

10. The chimney cap of claim 9, further comprising a flared lip attached to the mounting flange extending upward and outward from the mounting flange.

11. The dripless chimney cap of claim 9, wherein the second air vent is a screen mesh.

12. The dripless chimney cap of claim 9 wherein the top cap and drip pan have a generally circular cross-sectional shape.

13. The dripless chimney cap of claim 9 wherein the top cap and drip pan have a generally oval cross-sectional shape.

14. The dripless chimney cap of claim 9 wherein the top cap and drip pan have a generally rectangular cross-sectional shape.

15. The dripless chimney cap of claim 9 wherein the top cap and drip pan have a generally square cross-sectional shape.

16. The dripless chimney cap of claim 9 further comprising a drip pan extension extending toward the center of the chimney opening beyond than the mounting flange.

17. A method for reducing staining from condensates dripping down an outside surface of a chimney comprising the steps of:

a) providing a top cap over a chimney opening;

b) directing combustion gases exiting the chimney opening to impinge upon the top cap causing condensate to form and drip downward;

c) collecting the dripping condensate in a drip pan; and d) directing the condensate back into the chimney opening;

wherein, the top cap comprises a surface sloping downward in an outward radial direction over the chimney opening;

the drip pan is connected to, and spaced apart from, a lower side of the top cap and comprises a surface sloping downward radially toward an open center and a perimeter located within a perimeter of the top cap that forms a first continuous air vent thereabove with the lower side of the top cap;

a gap is defined between the top cap and the drip pan that converges in an outward radial direction towards the first continuous air vent; and a second air vent is connected between the drip pan and a mounting flange;

the mounting flange used for mounting the dripless chimney cap to a top end of a chimney pipe; and wherein an entrance to the second air vent is in fluid communication with an entrance to the first continuous air vent via a first continuous air vent structure.

18. The method of claim 17 wherein the surface of the top cap slopes downwardly and outwardly to a lip on its outermost extent.

19. The method of claim 17 wherein the mounting flange further comprises a flared lip extending upward and outward.

20. The method of claim 17 further comprising a drip pan extension extending toward the center of the chimney opening beyond than the mounting flange.

* * * * *